US005121285A

United States Patent [19]

McClure

[11] Patent Number: 5,121,285

[45] Date of Patent: Jun. 9, 1992

[54] METHOD AND APPARATUS FOR ELIMINATING RESIDUAL CHARGE ON PLASTIC SHEETS HAVING AN IMAGE FORMED THEREON BY A PHOTOCOPIER

[75] Inventor: Richard J. McClure, San Diego, Calif.

[73] Assignee: Eastman Kodak Company, Rochester, N.Y.

[21] Appl. No.: 653,211

[22] Filed: Feb. 11, 1991

[51] Int. Cl.[5] ..... H05F 3/00

[52] U.S. Cl. ..... 361/214; 361/212

[58] Field of Search ..... 361/212-215, 361/225-233, 235; 355/219, 208; 430/35, 48, 102; 356/443, 444; 250/324-326; 324/452-458

[56] References Cited

U.S. PATENT DOCUMENTS

| | | | |
|---|---|---|---|
| 3,670,203 | 6/1972 | Whitmore, Jr. et al. | 361/225 |
| 3,787,706 | 1/1974 | DeGeest | 361/212 |
| 3,822,093 | 7/1974 | Whited | 250/325 X |
| 3,854,942 | 12/1974 | Akman | 430/47 |
| 3,863,108 | 1/1975 | Blythe et al. | 361/212 |
| 4,027,201 | 5/1977 | Bacon et al. | 361/213 |
| 4,070,189 | 1/1978 | Kelley et al. | 430/527 |
| 4,071,362 | 1/1978 | Takenaka et al. | 430/126 |
| 4,167,325 | 9/1979 | Plumadore | 361/229 X |
| 4,271,451 | 6/1981 | Metz | 361/213 |
| 4,318,002 | 3/1982 | Pressman et al. | 250/492.2 |
| 4,320,186 | 3/1982 | Kato et al. | 430/98 |
| 4,363,070 | 12/1982 | Kisler | 361/212 |
| 4,370,379 | 1/1983 | Kato et al. | 428/341 |
| 4,415,626 | 11/1983 | Hasenauer et al. | 428/323 |
| 4,449,808 | 5/1984 | Abreu | 250/324 X |
| 4,480,003 | 10/1984 | Edwards et al. | 428/329 |
| 4,526,847 | 7/1985 | Walker et al. | 430/18 |
| 4,579,441 | 4/1986 | Hart et al. | 361/214 X |
| 4,739,363 | 4/1988 | Hoshika et al. | 361/214 X |
| 4,804,602 | 2/1989 | Buettner et al. | 430/42 |
| 5,059,990 | 10/1991 | Abreu et al. | 355/219 X |

*Primary Examiner*—A. D. Pellinen
*Assistant Examiner*—Fritz Fleming
*Attorney, Agent, or Firm*—Dennis P. Monteith

[57] ABSTRACT

A method of, and apparatus for, applying charge to a plastic, electrically conductive sheet having an image formed thereon by a photocopier, to neutralize the buildup of electrostatic charge on the plastic sheet. The amount of charge applied to the plastic sheet, to prevent electrostatic adhesion, is determined as a function of the amount of toner forming the image on the plastic sheet. According to one embodiment of the present invention, the amount of toner forming the image is determined as a function of the average transparency of the plastic sheet.

20 Claims, 4 Drawing Sheets

METHOD AND APPARATUS FOR ELIMINATING RESIDUAL CHARGE ON PLASTIC SHEETS HAVING AN IMAGE FORMED THEREON BY A PHOTOCOPIER

BACKGROUND OF THE INVENTION

1. Field of the Invention

The present invention generally relates to a method and apparatus for preventing electrostatic adhesion of plastic transparencies having an image formed thereon by an electrophotographic process. More particularly, the invention relates to a method and apparatus for determining and applying a charge which eliminates uncompensated charge of toner forming the image.

2. Description Of The Prior Art

Electrophotographic copying machines are now being employed to transfer images to plastic sheets for use as transparencies with overhead projectors. Typically, for the electrophotographic copier and similar electrophotographic image forming apparatus, visible patterns are produced from a latent image, formed by exposing a sensitive layer to light, which is then made visible by a dry-process technique.

In general, the sensitive layer is usually a photoconductor which is charged. On exposure, the latent image is formed as a pattern of charge and then made visible during development by having finely divided powders attracted electrostatically to the charged areas of the latent image.

Development of the image involves the attraction of small, oppositely charged particles to the electrostatic image configuration of the sensitive layer. Such small particles, usually charged, are referred to as toner. The developed image is then transferred to copy paper or a plastic sheet, if a transparency is being produced. This image transfer is facilitated by charging the copy paper with a charge opposite to that of the toner, for example by a transfer corona wire, so that toner is attracted away from the sensitive layer to the copy paper.

After the toner image transferred to the copy paper has been developed, such as, for example, by fusing or the like, the charge of the copy paper, used to attract the toner, is neutralized by application of an opposite charge. However, the oppositely charged toner is not neutralized which results in a small, but uncompensated residual charge.

When employing such an electrostatic photographic process to produce transparencies for use with overhead projectors, the images are usually formed on plastic sheets, such as PET sheets, which are treated to have a surface resistivity in the range of $2\times10^{10}$ to $1\times10^{13}$ ohms/sq As a result, the uncompensated toner charge gradually spreads over the surface of the transparency due to this surface conductivity after the symmetrically induced transfer charge of the transparency has been removed at the exit of the copier by the usual means.

A significant problem results in that the transparencies electrostatically stick together and are hard to separate when needed for display. This problem can persist for many hours, and even days.

Prior art attempts to address this problem typically involve providing the transparency with an antistatic layer or antistatic agent. Such transparencies are disclosed by, for example, U.S. Pat. Nos. 3,854,942, 4,070,189, 4,071,362, 4,415,626, 4,370,379, 4,480,003, 4,526,847, and 4,320,186. However, the provision of an antistatic layer or the application of an antistatic agent results in an increase in cost of the transparencies.

As noted above, the electrostatically charged copy paper is typically neutralized, for example, by a discharge electrode such as disclosed by U.S. Pat. Nos. 4,579,441 and 4,739,363. While effective in neutralizing the symmetrical charge of the photocopy sheet, such discharge electrodes make no provision for measuring or removing the residual charge of the toner forming the image thereon. Additionally, it is known in multicolor photographic image copying processes to reverse charge the medium after a toner of a first color has been applied to neutralize trapped charges and substantially revitalize the medium as disclosed by U.S. Pat. No. 4,804,602 or neutralize incompletely developed images by the application of a reverse charge as disclosed by U.S. Pat. No. 4,318,002. In each of these arrangements, however, a set charge is applied to the medium to neutralize its charge and no sensing or determination of the residual charge of the toner on the medium is made.

Also known are arrangements for controlling the charge on a moving web, such as disclosed by U.S. Pat. Nos. 3,787,706, 3,863,108, 4,271,451, and 4,363,070. These arrangements are directed to the problem resulting from the transfer of electrostatic charges to a moving web due to friction as the web moves over rollers or the like. An electro-meter is typically provided to sense the electrostatic charge on the web and a charge of opposite polarity is applied to the web during transfer. However, these arrangements do not involve the elimination of residual charge on plastic sheets having an image formed by an electrostatic photocopier or the like.

SUMMARY OF THE INVENTION

Therefore, it is a primary object of the present invention to provide a method and apparatus for preventing electrostatic adhesion of plastic sheets having toner images formed thereon by an electrostatic imaging process.

A further object of the present invention is to provide a method and apparatus for determining and applying an amount of charged to a plastic sheet to eliminate uncompensated charges in toner forming an image thereon.

Yet another object of the present invention is to provide a method and apparatus for measuring an amount of toner forming an image on a plastic sheet to determine an uncompensated charge thereof. According to one embodiment of the present invention, a method is provided for neutralizing the buildup of electrostatic charge on a plastic, electrically conductive sheet having an image formed thereon by a photocopier which deposits charged toner during an electrostatic imaging process. According to this first embodiment, the method comprises the steps of: measuring an average transparency of the plastic sheet with an image formed thereon; determining an uncompensated charge of the toner forming the image on the plastic sheet as a function of the average transparency of the sheet; and applying a charge to the plastic sheet which is equal to and opposite in sign to the uncompensated charge of the toner.

According to a further embodiment of the present invention, a method for neutralizing buildup of electrostatic charge on a plastic photoconductive sheet comprises the steps of: measuring an amount of toner forming the image on the plastic sheets; determining an uncompensated charge of the toner forming the image; and applying a charge to the plastic sheet which is equal to and opposite in sign to the uncompensated charge of the toner to prevent electrostatic adhesion.

According to yet another embodiment of the present invention there is provided an apparatus for neutralizing buildup of electrostatic charge on Plastic, electrically conductive sheets comprising: measuring means for measuring an average transparency of the plastic sheet with a toner image; charge determining means for determining an uncompensated charge of the toner forming the image as a function of the average transparency of the plastic sheet; and a charge applying arrangement for applying a charge to the sheet which is equal to and opposite in sign to the uncompensated charge of the toner.

One particular advantageous feature of the present invention is that the uncompensated charge of the toner forming the image on the plastic sheet can be determined continuously as a function of the average transparency of the sheet and a neutralizing charge can be applied continuously, as the sheet is transported past a given location, in accordance with a current value of the uncompensated charge as determined.

Yet another advantageous feature of the present invention is the arrangement of the measuring means for measuring an average transparency of the plastic sheet. The measuring means includes an illuminating arrangement for illuminating an entire width of the plastic sheet as the sheet is transported past a given location and a light sensing arrangement for sensing light transmission through the entire width of the sheet illuminated. This arrangement permits the output of the light sensing arrangement to be employed to determine a current uncompensated charge of the toner as a function of the sheet's average transparency so that the appropriate charge can be continuously applied to the sheet as it passes a given location.

These advantages, as well as other advantages of the present invention, will become more apparent in the detailed description of preferred embodiments presented below. dr

DETAILED DESCRIPTION OF THE PREFERRED EMBODIMENTS

Figure 1:
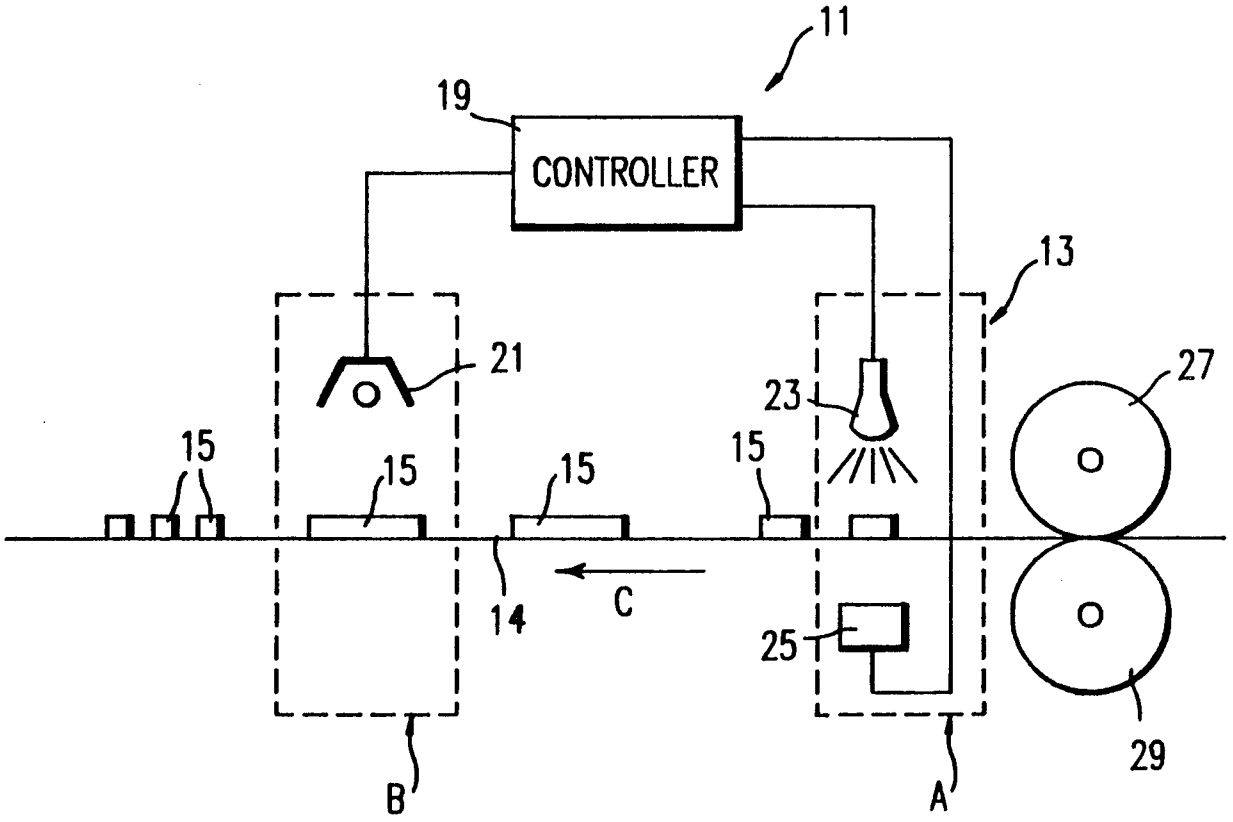
FIG. 1 illustrates one embodiment of apparatus, in accordance with the invention, for neutralizing buildup of electrostatic charge on a plastic sheet due to the uncompensated charge of toner forming an image thereon.

Referring to FIG. 1, one embodiment of an apparatus for neutralizing the buildup of electrostatic charge on a plastic, electrically conductive sheet is generally illustrated at reference numeral 11. The apparatus 11 comprises a measuring arrangement 13 for measuring an average transparency of a plastic sheet 14 having a given amount of toner 15 forming a toner image fixed thereon as well as a controller 19 for receiving the output from the measuring arrangement 13 to determine an uncompensated charge of the toner 15 forming the image on the plastic sheet 14. Also provided is a charge applying arrangement 21, for example a corona discharge wire, controlled by the controller 19. for applying a charge to the plastic sheet 14 which is equal to and opposite in polarity to the uncompensated charge of the toner 15 to prevent electrostatic adhesion.

According to one embodiment of the apparatus 11, the measuring arrangement 13 comprises a light source 23 for illuminating the plastic sheet 14 with radiant energy and a photosensor or photoconductor 25 arranged to receive light transmitted through the sheet 14 as it is transported in direction C, for example by transfer rollers 27, 29, past a given location generally indicated at A. The output of the photoconductor 25 varies in dependence upon the average transparency of the sheet 14 which is a function of the amount of toner 15 applied to the sheet 14 at different locations. The variable output of the photoconductor 25 is received by the controller 19, which comprises, for example, a programmable computer or the like which can be programmed to calculate the residual charge of the toner 15 forming the image on the plastic sheet 14 as a function of the output of the photoconductor 25.

Such a programming of the controller 19 is possible because the average transparency of the sheet 14 with the toner image and the output of the photoconductor 25 are dependent on the amount of toner forming the image on the sheet 14, and because the amount of charge applied per unit of toner is a known quantity. Therefore, the output of the photoconductor 25 can be functionally related to the residual charge of the toner 15 forming the image. Such a function relationship can be predetermined and employed to calculate the residual charge of the toner 15. Alternatively, residual charge values for given photoconductor outputs can be stored, for example in a look-up table, so that the controller 19 can use the look-up table to match a given output value of the photoconductor 25 to a corresponding residual charge to be compensated.

Alternatively, the controller 19 can be programmed to calculate or determine the amount of toner 15 forming the image as a function of the difference between the average transparency of the plastic sheet 14 with the toner image applied thereto, as sensed by the photoconductor 25, and a standard value, typically the transparency of a standard plastic sheet without an image. As noted above, since the standard charge of the toner 15 is known, from this calculated toner amount, the controller 19 determines the uncompensated charge of the toner by multiplying the amount of toner 15 forming the image times the quanta of charge applied per unit amount of toner.

According to one embodiment of the present invention, the amount of toner and uncompensated charge thereof is continuously determined, i.e., from a look-up table, or calculated by the controller 19 as the plastic sheet 14 is transported by transfer rollers 27, 29 in the direction C past the given location A at which, for example, the measuring arrangement 13 is provided. In this embodiment of the invention, the controller 19 controls the charge applied to the sheet 14 by the charge applying arrangement 21 in accordance with a current value of the uncompensated charge of the toner image determined or calculated by the controller 19.

The charge value is then applied continuously to the sheet 14 as it passes a charge applying station, generally indicated at B, to eliminate the uncompensated charge of the toner.

In this regard, the application of the charge can be delayed by the controller 19 in accordance with the speed of transport of the sheet 14 in the direction C by the transfer rollers 27, 29 so that the charge is applied directly to the specific toner quantity sensed by the sensing arrangement 13 to generate the current charge value necessary to neutralize the residual charge thereof. Alternatively, the charge can be applied without such a delay or cumulatively determined or calculated for the entire sheet and applied all at once.

Figure 2:
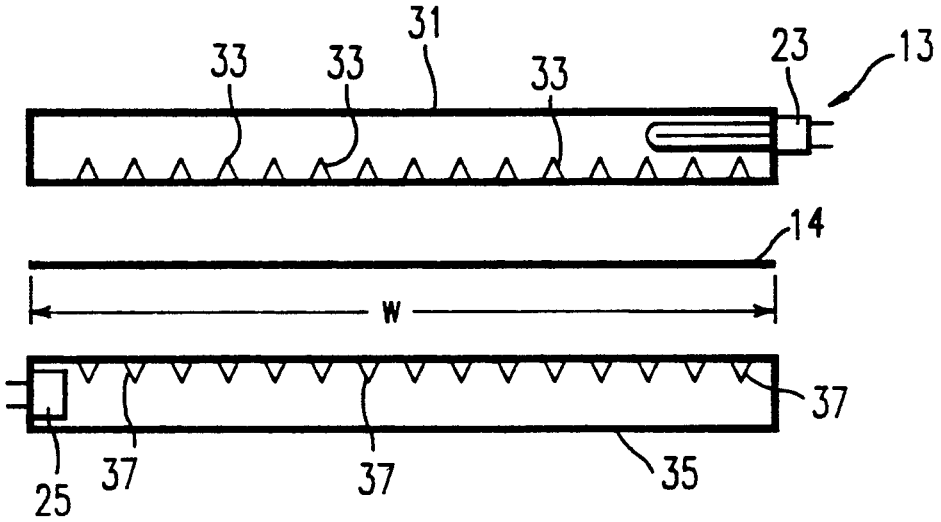
FIGS. 2–3 are, respectively, planar and side views of an alternative embodiment of the invention showing apparatus for measuring an amount of toner forming an image on the plastic sheet.
Figure 3:
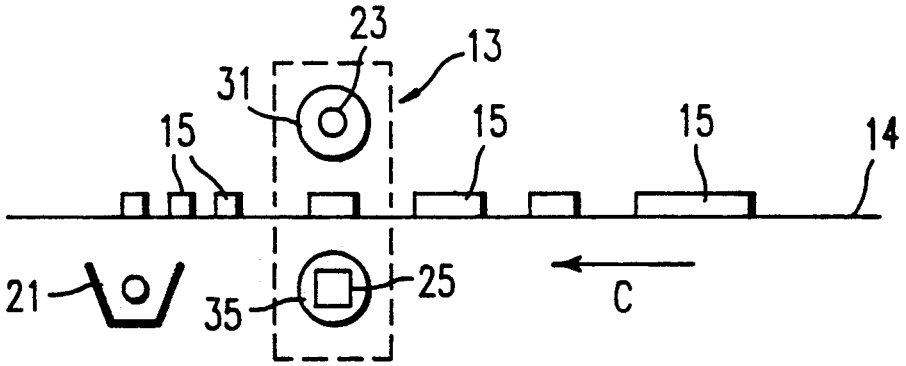

FIGS. 2 and 3 illustrate one embodiment of the measuring arrangement 13 wherein an entire width of the plastic sheet 14 is illuminated as it passes the sensing location A and light transmission therethrough is sensed. In this particular embodiment, the light source 23 is provided at one end of a light pipe or optical fiber 31 which extends across the entire width W of the plastic sheet 14. The light pipe 31 is provided with hash marks or surface disturbances 33 to couple light from the light source 23 out of the light pipe 31 and toward the plastic sheet 14. Similarly, the photoconductor 25 is provided at one end of another light pipe 35 also provided with hash marks 37 to couple light received axially into the light pipe 35 for sensing by the photoconductor 25.

Thus, as seen in FIGS. 2 and 3, the light source 23 essentially extends over an entire width of the plastic sheet 14 as it is transported in a direction C past the measuring arrangement 13. Light transmitted through the entire width of the plastic sheet 14 is received and sensed by the photoconductor 25 via the light pipe 35 to provide an output indicative of the average transparency of the sheet 14.

Since toner 15 on the illuminated surface of the plastic sheet 14 reduces light transmission therethrough, the output of the photoconductor 25 varies to cause the controller 19 to generate a compensation charge value as a function thereof. The compensation surface charge is then added to the sheet 14 by the charge applying means 21 in proportion to the average transparency sensed by the photoconductor 25 and the uncompensated charge of the toner forming the image is neutralized.

Figure 4:
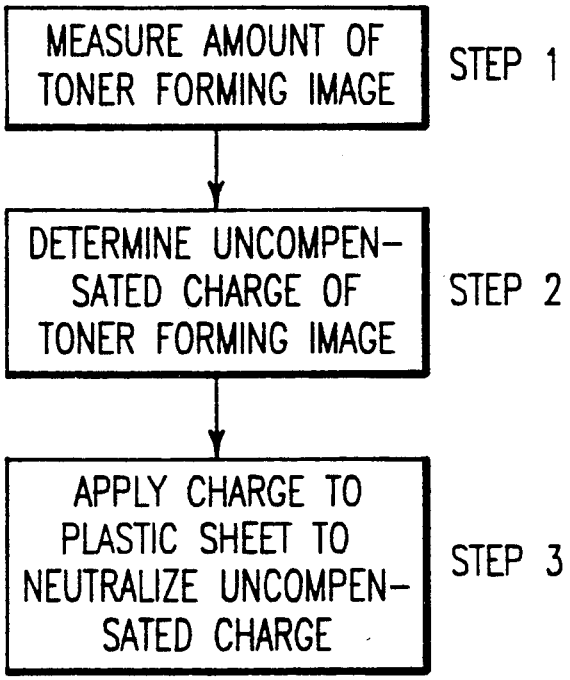
FIG. 4 is a block diagram illustrating one embodiment of a method of the present invention.

Referring now to FIG. 4, one embodiment of a method of the present invention, as performed by the apparatus described previously with respect to FIGS. 1-3, is illustrated. In this particular arrangement, the amount of toner 15 forming the toner image on the plastic sheet is measured in step 1, such as, for example, by the measuring arrangement 13 illustrated in FIGS. 1-3. Thereafter, an uncompensated charge of the toner forming the toner image is determined in step 2, for example, by the controller 19 previously described. Then, a charge is applied to the plastic sheet 14 which is equal to and opposite in polarity to the uncompensated charge of the toner image to prevent electrostatic adhesion, for example, by the charge applying arrangement 21 under the control of the controller 19.

Figure 5:
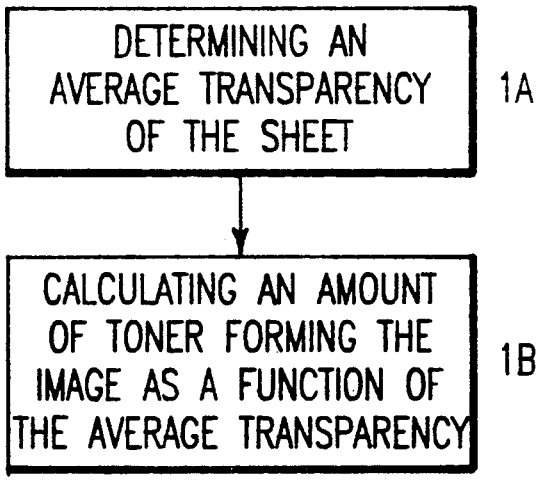
FIG. 5 is a block diagram illustrating one embodiment of a measuring step of the method of FIG. 4.

With particular reference to FIG. 5, the determining step 1 discussed above can be performed in a two step process wherein an average transparency of the plastic sheet is determined in step 1A by, for example, the sensing arrangement 13 previously discussed and thereafter in step 1B the amount of toner forming the image can be calculated as a function of the average transparency of the plastic sheet for example, by the controller 19.

Figure 6:
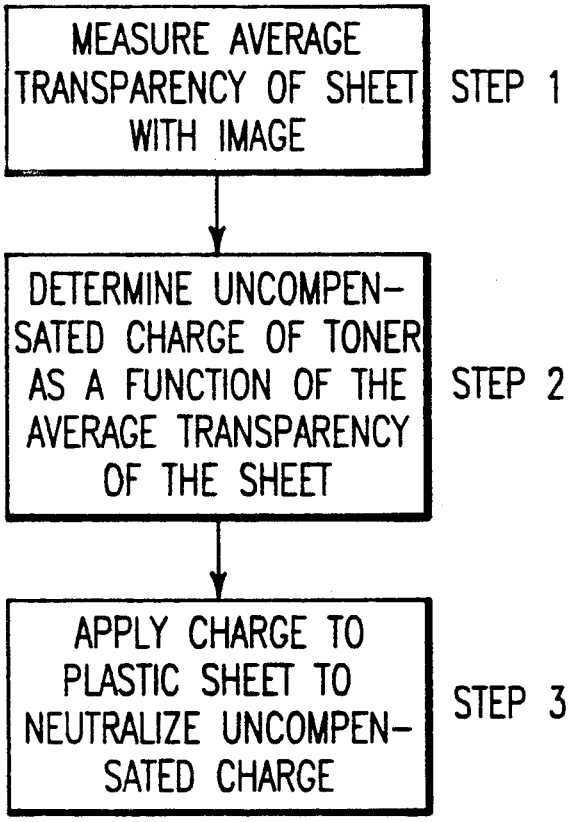
FIG. 6 is a block diagram of a further embodiment of the method of the present invention.

FIG. 6 illustrates a further embodiment of the present invention. In this particular embodiment, the average transparency of the sheet with the image is determined in step 1 from, for example, the output of photoconductor 25 then, in step 2, the uncompensated charge of the toner is determined as a function of the average transparency of the sheet by the controller 19 as previously described. Thereafter, in step 3, an appropriate charge is applied to the plastic sheet to neutralize the uncompensated charge of the toner image.

While there has been shown what are considered to be the preferred embodiments of the invention, it will be manifest that many changes and modifications may be made therein without departing from the essential spirit of the invention. It is intended, therefore, in the annexed claims, to cover all such changes and modifications as they fall within the true scope of the invention.

I claim:

1. A method for neutralizing buildup of electrostatic charge on a plastic, electrically conductive sheet having a toner image formed thereon by a photocopier which deposits charged toner during an electrostatic imaging process, the method comprising:

measuring an amount of toner forming the image on the plastic sheet;

determining an uncompensated charge of the toner forming the image on the plastic sheet as a function of the amount of toner forming the image; and applying a charge to the plastic sheet that is equal to and opposite in polarity to the uncompensated charge of the toner, to prevent electrostatic adhesion.

2. A method according to claim 1, wherein said measuring step comprises:

determining an average transparency of the plastic sheet with the image; and determining the amount of toner forming the image as a function of the average transparency of the plastic sheet.

3. A method according to claim 2, wherein said step of determining the average transparency of the sheet comprises:

illuminating the plastic sheet with radiant energy; and sensing radiant energy transmission through the plastic sheet to determine the average transparency thereof.

4. A method according to claim 3, wherein said illuminating step comprises illuminating an entire width of the plastic sheet as the sheet is transported past a first given location after the toner image has been fixed

5. A method according to claim 4, wherein said step of determining the uncompensated charge of the toner comprises:

calculating the uncompensated charge of the toner by multiplying the amount of toner forming the image on the plastic sheet times a predetermined charge per unit amount of toner.

6. A method according to claim 5, wherein said step of determining the uncompensated charge of the toner deposited on the plastic sheet is performed continuously as the plastic sheet is transported past said first given location.

7. A method according to claim 6, wherein said step of applying charge to the plastic sheet is performed continuously as the plastic sheet is transported past a second given location.

8. A method for neutralizing buildup of electrostatic charge on a plastic, electrically conductive sheet having a toner image formed thereon by a photocopier which deposits charged toner during an electrostatic imaging process, said method comprising the steps of:

measuring an average transparency of the plastic sheet with the image;

determining an uncompensated charge of the toner forming the image on the plastic sheet as a function of the average transparency of the plastic sheet; and applying a charge to the plastic sheet that is equal to and opposite in polarity to the uncompensated charge of the toner, to prevent electrostatic adhesion.

9. A method according to claim 8, wherein said measuring step comprises:

illuminating the plastic sheet with radiant energy; and sensing radiant energy transmission through the plastic sheet using a photoconductor.

10. A method according to claim 9, wherein said step of determining the uncompensated charge of the toner comprises the step of:

calculating the uncompensated charge of the toner as a function of an output of the photoconductor.

11. A method according to claim 10, wherein said illuminating step comprises illuminating an entire width of the plastic sheet as the sheet is transported past a given location after the toner has been fixed.

12. A method according to claim 11, wherein said step of determining the uncompensated charge of the toner is performed continuously as the plastic sheet is transported.

13. A method according to claim 12, wherein said step of applying charge to the plastic sheet is performed continuously as the plastic sheet is transported.

14. Apparatus for neutralizing buildup of electrostatic charge on a plastic, electrically conductive sheet having a toner image formed thereon by a photocopier which deposits charged toner during an electrostatic imaging process, said apparatus comprising:

measuring means for measuring an average transparency of the plastic sheet with the image;

charge determining means for determining an uncompensated charge of the toner forming the toner image on the plastic sheet as a function of the average transparency of the plastic sheet; and charge applying means for applying to the plastic sheet a charge which is equal to and opposite in polarity to the uncompensated charge of the toner, to prevent electrostatic adhesion.

15. Apparatus according to claim 14, wherein said measuring means comprises:

illuminating means for illuminating the plastic sheet with radiant energy; and sensing means for sensing radiant energy transmission through the plastic sheet.

16. Apparatus according to claim 15, wherein said charge determining means comprises:

means for determining the uncompensated charge of the toner as a function of an output of the sensing means.

17. Apparatus according to claim 16, wherein said illuminating means includes means for illuminating an entire width of the plastic sheet as the sheet is transported past a first given location after the toner has been fixed, and said sensing means comprises means for sensing light transmission through the entire width of the sheet illuminated.

18. Apparatus according to claim 17, wherein said charge determining means continuously determines the uncompensated charge of the sheet as the plastic sheet is transported past said first given location.

19. Apparatus according to claim 18, wherein said charge applying means applies charge to the plastic sheet continuously as the plastic sheet is transported past a second given location in proportion to a current uncompensated charge of the sheet as continuously determined by said determining means.

20. Apparatus according to claim 14, wherein said charge determining means is a look-up table for stored values relating the measured transparency of the sheet to the uncompensated charge of the toner corresponding to the measured transparency.

* * * * *